US005481947A

United States Patent [19]

Banns

[11] Patent Number: 5,481,947

[45] Date of Patent: Jan. 9, 1996

[54] T LEVER ADAPTER FOR A RATCHET WRENCH

[76] Inventor: Stoke Banns, 12478 223rd St., Maple Ridge, British Columbia, Canada, V2X 5Y9

[21] Appl. No.: 404,448

[22] Filed: Mar. 15, 1995

[51] Int. Cl.[6] ..... B25B 23/16

[52] U.S. Cl. ..... 81/177.2; 81/177.8; 81/184

[58] Field of Search ..... 81/177.2, 177.8, 81/177.7, 184, 58.1

[56] References Cited

U.S. PATENT DOCUMENTS

| | | | |
|---|---|---|---|
| 934,503 | 9/1909 | Chapman | 81/177.7 |
| 1,370,194 | 1/1921 | Cunha . | |
| 1,459,708 | 6/1923 | Powers . | |
| 2,465,152 | 3/1949 | Ellison . | |
| 2,675,840 | 4/1954 | Daiber . | |
| 2,886,998 | 5/1959 | Scott | 81/177.7 |
| 3,572,188 | 3/1971 | Christian, Jr. . | |
| 3,863,693 | 2/1975 | Carriker . | |
| 4,065,987 | 1/1978 | Rager . | |
| 4,308,770 | 1/1982 | MacDonald | 81/177.2 |
| 4,546,676 | 10/1985 | Kiefer, Jr. . | |
| 5,001,947 | 3/1991 | Andersen-Vie . | |
| 5,020,397 | 6/1991 | Minuto . | |

FOREIGN PATENT DOCUMENTS

| | | | |
|---|---|---|---|
| 349949 | 7/1905 | France | 81/177.7 |

*Primary Examiner*—Bruce M. Kisliuk
*Assistant Examiner*—Joni B. Danganan
*Attorney, Agent, or Firm*—Anthony R. Lambert

[57] ABSTRACT

A T lever adapter for a ratchet wrench is described which includes a body having a generally "U" shaped channel. The channel is adapted to receive in mating engagement a head of a ratchet wrench. Clamps are secured to the body at opposed ends of the channel. This enables the head of the ratchet wrench to be clamped in engagement with the channel. A handle extends from the body. The handle being substantially coaxial with a handle of the ratchet wrench when the head of the ratchet wrench is received in the channel.

5 Claims, 2 Drawing Sheets

T LEVER ADAPTER FOR A RATCHET WRENCH

FIELD OF THE INVENTION

The present invention relates to a T lever adapter for a ratchet wrench.

BACKGROUND OF THE INVENTION

A T lever adapter is used in conjunction with a ratchet wrench when it is important that equal torque be produced about the axis of the ratchet wrench. This primarily occurs when difficulty is being experienced in removing a nut. To proceed in such a situation, in the absence of a T lever adapter, is to risk damage to the socket secured to the ratchet wrench, damage to the nut positioned in the socket and the potential of injury to the person in the event of slippage.

U.S. Pat. No. 4,065,987 which issued to Rager in 1978 is an example of one form of T lever adapter. The Rager reference discloses a hollow cylindrical ring, a handle member extending radially from the ring, and a trough-like member extending radially from the ring in a direction diametrically opposite to the handle member. A head of a ratchet wrench is coaxially positioned in the ring with a handle of the ratchet wrench accommodated for part of its length in the trough-like member.

SUMMARY OF THE INVENTION

The present invention relates to an alternate form of T ever adapter.

According to the present invention there is provided a T lever adapter which includes a body having a generally "U" shaped channel. The channel is adapted to receive in mating engagement a head of a ratchet wrench. Clamping means are secured to the body at opposed ends of the channel. This enables the head of the ratchet wrench to be clamped in engagement with the channel. A handle extends from the body. The handle being substantially coaxial with a handle of the ratchet wrench when the head of the ratchet wrench is received in the channel.

The T lever, as described above, is capable of engaging a head of a ratchet wrench, such that the handle of the T lever and the handle of the ratchet wrench form cross members of a T shape with a socket engaging coupling of the ratchet wrench forming a base of the T shape. There are a variety of clamping means which can be utilized. It is preferred that the clamping means includes levers pivotally mounted to the opposed ends of the channel for movement between engaged and disengaged positions. Each of the levers have a handle end and a head end. The head end engages the head of the ratchet wrench to clamp it securely in the channel in the engaged position. It is also preferred that the handle ends of the clamping levers are positioned against the handle of the ratchet wrench when in the engaged position.

Although beneficial results may be obtained from the T lever, as described above, even more beneficial results may be obtained by modifications that turn the ratchet wrench into a speed wrench. This is accomplished when the handle is pivotally mounted to the body. It is preferred that the handle has a pivot axis which extends perpendicularly to a rotational axis of a socket engaging coupling on the ratchet wrench. It is also preferred that the body has stop means to limit the pivotal movement of the handle.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
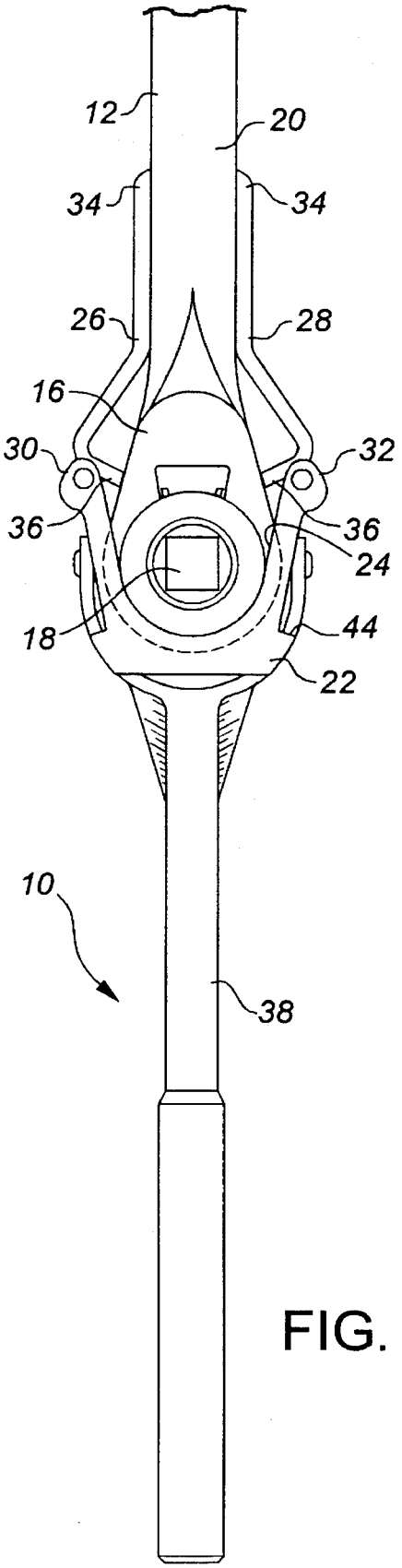
FIG. 1 is a bottom plan view of a T lever adapter constructed in accordance with the teachings of the present invention.
Figure 2:
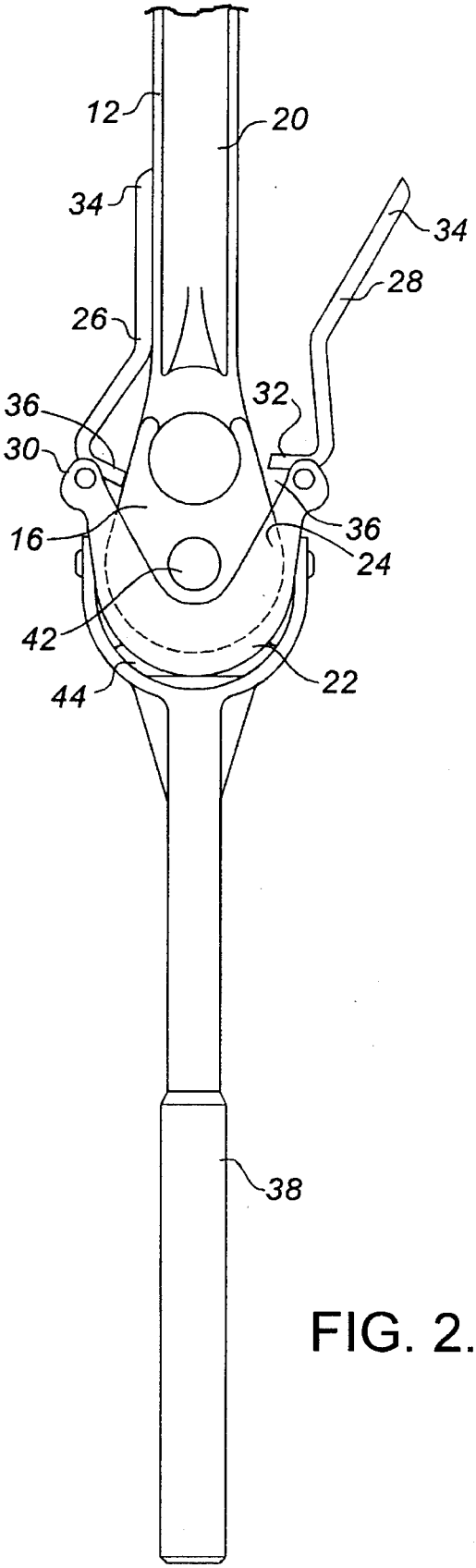
FIG. 2 is a top plan view of the T lever adapter illustrated in FIG. 1.
Figure 3:
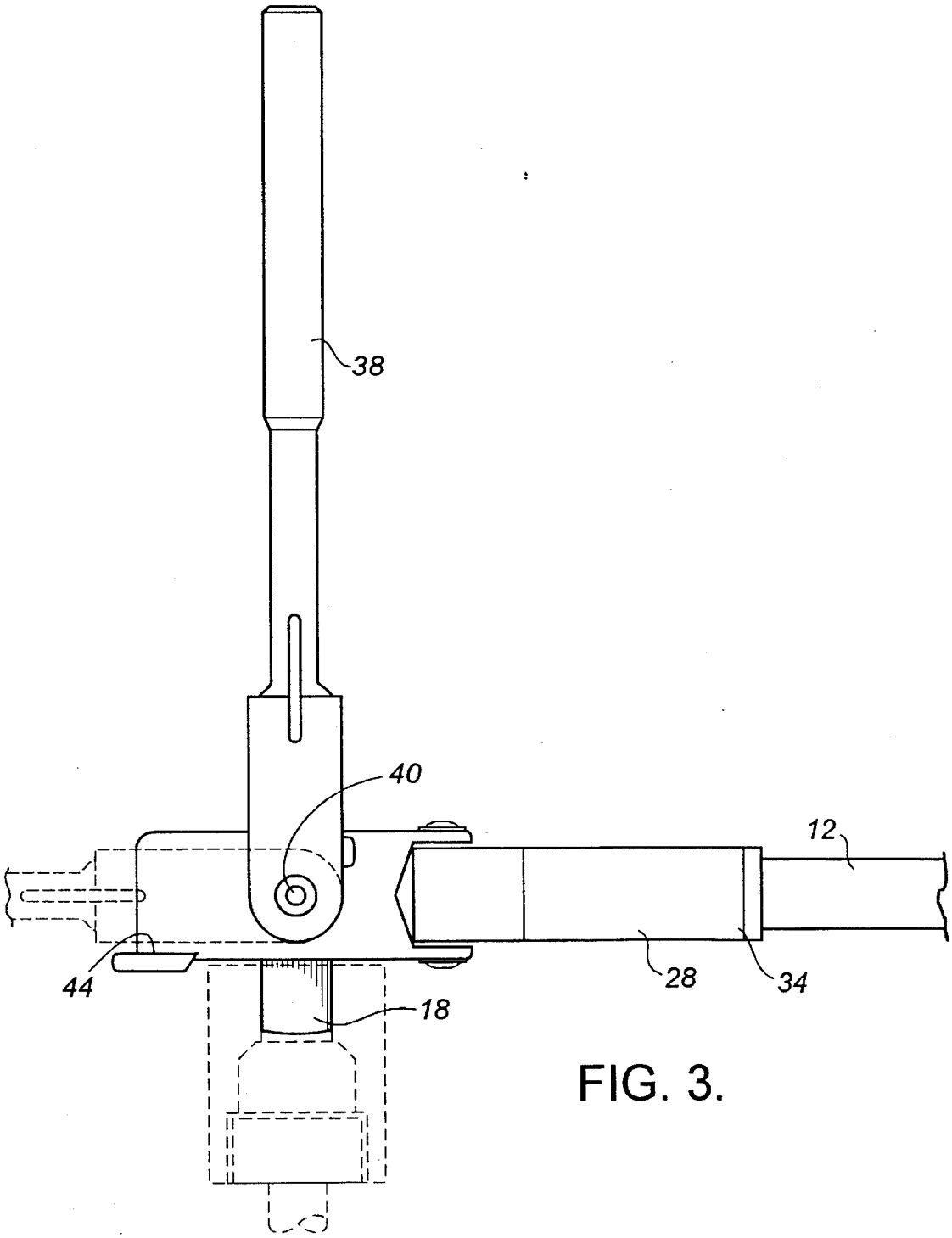
FIG. 3 is a side elevation view of the T lever adapter illustrated in FIG. 1.

The preferred embodiment, a "T" lever adapter generally identified by reference numeral 10, will now be described with reference to FIGS. 1 through 3.

T lever adapter 10 is intended for use with a ratchet wrench 12 having a head 16 with a socket engaging coupling 18 and a handle 20. T lever adapter 10 includes a body 22 having a generally "U" shaped channel 24. Channel 24 is adapted to receive in mating engagement head 16 of ratchet wrench 12. Clamping levers 26 and 28 are pivotally mounted to opposed ends 30 and 32, respectively, of channel 24 for movement between engaged and disengaged positions. Each of levers 26 and 28 has a handle end 34 and a head end 36. Referring to FIG. 1, in the engaged position head end 36 engages head 16 of ratchet wrench 12 to clamp head 16 securely in channel 24 and handle ends 34 are positioned against handle 20 of ratchet wrench 12. Referring to FIG. 2, in the disengaged position handle ends 34 are removed from handle 20 of ratchet wrench 12 and head ends 36 pivot out of the way to permit head 16 of ratchet wrench 12 to be withdrawn from "U" shaped channel 24. T lever adapter 10 also includes a handle 38 pivotally mounted to body 22. Handle 38 is substantially coaxial with handle 20 of ratchet wrench 12 when head 16 of ratchet wrench 12 is received in channel 24. Referring to FIG. 2, handle 38 has a pivot axis 40 which extends perpendicularly to a rotational axis 42 of coupling 18 on head 16 of ratchet wrench 12. A stop 44 is provided on body 22 to limit the pivotal movement of handle 40.

The use and operation of T lever adapter 10 will now be described with reference to FIGS. 1 through 3. When it is desired to apply increased torque to ratchet wrench 12, head 16 of ratchet wrench 12 is slid into "U" shaped channel 24 of T lever adapter 10. Once in position head 16 is locked in position by pivoting clamping levers 26 and 28 into the engaged position. In the engaged position, as illustrated in FIG. 1, head end 36 of clamping levers 26 and 28 engage head 16 of ratchet wrench 12 to clamp head 16 securely in channel 24 and handle ends 34 of clamping levers 26 and 28 are positioned against handle 20 of ratchet wrench 12. T lever adapter 10 forms a generally "T" shaped configuration, as illustrated in FIGS. 1 and 2, as well as in ghost lines on FIG. 3. In restricted quarters that do not provide enough room for the "T" configuration, handle 38 may be pivoted to the substantially perpendicular position illustrated in FIG. 3, and it will still provide some additional leverage. In the position illustrated in FIG. 3, handle 38 may be used as a "speed handle" to rapidly manipulate ratchet wrench 12, once the resistance has been overcome and ratchet wrench is turning freely.

It will be apparent to one skilled in the art that modifications may be made to the illustrated embodiment without departing from the spirit and scope of the invention as defined by the Claims, The embodiments of the invention in which an exclusive property or privilege is claimed are as follows:

1. A T lever adapter, comprising:

a. a body having a generally "U" shaped channel, the channel being adapted to receive in mating engagement a head of a ratchet wrench;

b. clamping means secured to the body at opposed ends of the channel, whereby the head of the ratchet wrench is clamped in engagement with the channel, the clamping means including levers pivotally mounted to the opposed ends of the channel for movement between engaged and disengaged positions, each of the levers having a handle end and head end, the head end engaging the head of the ratchet wrench to clamp it securely in the channel in the engaged position; and c. a handle extending from the body, the handle being substantially coaxial with a handle of the ratchet wrench when the head of the ratchet wrench is received in the channel, the handle ends of the clamping levers being positioned against the handle of the ratchet wrench when in the engaged position.

2. The T lever adapter as defined in claim 1, wherein the handle is pivotally mounted to the body.

3. The T lever adapter as defined in claim 2, wherein the handle has a pivot axis which extends perpendicularly to a rotational axis of a socket engaging coupling on the ratchet wrench.

4. The T lever adapter as defined in claim 2, wherein the body has stop means to limit pivotal movement of the pivotally mounted handle.

5. A T lever adapter, comprising:

a. a body having a generally "U" shaped channel, the channel being adapted to receive in mating engagement a head of a ratchet wrench;

b. clamping levers pivotally mounted to the opposed ends of the channel for movement between engaged and disengaged positions, each of the levers having a handle end and a head end, the head end engaging the head of the ratchet wrench to clamp it securely in the channel in the engaged position, the handle ends of the clamping levers being positioned against the handle of the ratchet wrench when in the engaged position;

c. a handle pivotally mounted to the body, the handle being substantially coaxial with a handle of the ratchet wrench when the head of the ratchet wrench is received in the channel, the handle having a pivot axis which extends perpendicularly to a rotational axis of a socket engaging coupling on the ratchet wrench; and d. a stop on the body to limit the pivotal movement of the handle.

* * * * *